US006036026A

United States Patent [19]

Tranquilla

[11] Patent Number: 6,036,026

[45] Date of Patent: Mar. 14, 2000

[54] TECHNIQUE FOR CHECK SORTING

[75] Inventor: Michael N. Tranquilla, Livonia, Mich.

[73] Assignee: Unisys Corp., Blue Bell, Pa.

[21] Appl. No.: 08/713,067

[22] Filed: Sep. 14, 1996

Related U.S. Application Data

[60] Provisional application No. 60/004,711, Oct. 3, 1995.

[51] Int. Cl.[7] ..... B07C 5/16

[52] U.S. Cl. ..... 209/592; 209/604; 209/657; 209/900

[58] Field of Search ..... 209/552, 555, 209/556, 559, 562, 564, 565, 603, 604, 656, 657, 900, 592, 645

[56] References Cited

U.S. PATENT DOCUMENTS 4,927,031 5/1990 Martin ..... 209/657
5,310,062 5/1994 Stevens et al. ..... 209/603 X

FOREIGN PATENT DOCUMENTS 476769 3/1992 European Pat. Off. ..... 209/657

*Primary Examiner*—Tuan N. Nguyen

*Attorney, Agent, or Firm*—Mark Starr; J. McCormack

[57] ABSTRACT

An arrangement for automatically, selectably diverting, different-weight checks being transported along a prescribed track with divert-blade means at a prescribed divert-station therealong, said checks comprising "standard" and "non-standard", heavier versions, this arrangement comprising, in combination with the foregoing:

weight sense means, disposed along said track, upstream of said divert station, for sensing at least a mass characteristic of passing checks and outputting mass-indicating signals SS representative thereof; actuate means arranged to thrust said blade means across said track and associated actuate-adjust means for adjusting actuation-torque of said actuate means responsive to associated torque-adjust signals AA input thereto; and control means arranged to receive said mass-indicating signals SS, manipulating them and applying associated torque-adjust signals AA to said actuate-adjust means whereby to automatically adjust and control the torque applied to said blade means according to the sensed weight condition of a said check; said control means and actuate-adjust means being set to normally handle said "standard" weight checks, and adapted to increase actuation-torque upon detection of a "heavier" check.

10 Claims, 3 Drawing Sheets

TECHNIQUE FOR CHECK SORTING

This case is a Continuation of Provisional Application SN 60/004,711, for SMART SELECT UNIT FOR DOCUMENT DIVERSION, filed Oct. 3, 1995 and claims priority therefrom.

This relates to arrangements for sorting checks, and especially where the "sort-modes", and related "gates ", are made conditional and selectable according to document condition.

BACKGROUND, FEATURES

Workers in the art of transporting, processing and manipulating unit records (e.g., checks, mail, etc.) recognize that great advantages can be enjoyed where the manipulation (e.g., diversion) of a record can be made to automatically vary according to record condition (e.g., size, weight, etc.). Such is an object hereof In a preferred embodiment, I teach a system that reliably and efficiently diverts and routes documents into one of two paths based on pre-measured document size and interdocument spacing information. The preferred objective is to supply only minimal selector (diverter) gate forces and actuation speeds as are necessary for to the reliable document handling of a "following" (e.g., the very next) document that the gate must possibly handle—e.g., to maximize the service life of associated electrical and mechanical components; to minimize average energy expended over many gate actuations, and to reduce the cost of electrical and mechanical components. According to preferred features, this system determines (e.g., measures and computes) document conditions prior to invoking gate actuation and then sets gate actuation parameters according to these conditions.

ADVANTAGES OVER PAST PRACTICE

Previous document selector gates have been designed to work properly for "worst case" document sizes and interdocument spacings. In check sorters and postal sorters, for example, worst case document conditions occur rather infrequently. For the vast majority of gate actuations, this will waste energy, and electrical and mechanical components will be unnecessarily over-stressed. These two factors contribute to low gate life, high component costs, and high average acoustic noise.

By contrast, my subject system adjusts gate actuation speed and gate actuator forces to actual document condition—such that a gate is moved quickly and forcefully only when the (infrequent) "worst-case" document conditions occur, and is moved more slowly/less forcefully, when the (more frequent) "normal" document conditions obtain. This results in lower average acoustic noise. Less expensive components can be used; and life of components is increased because the components are highly stressed only when absolutely necessary.

Figure 1:
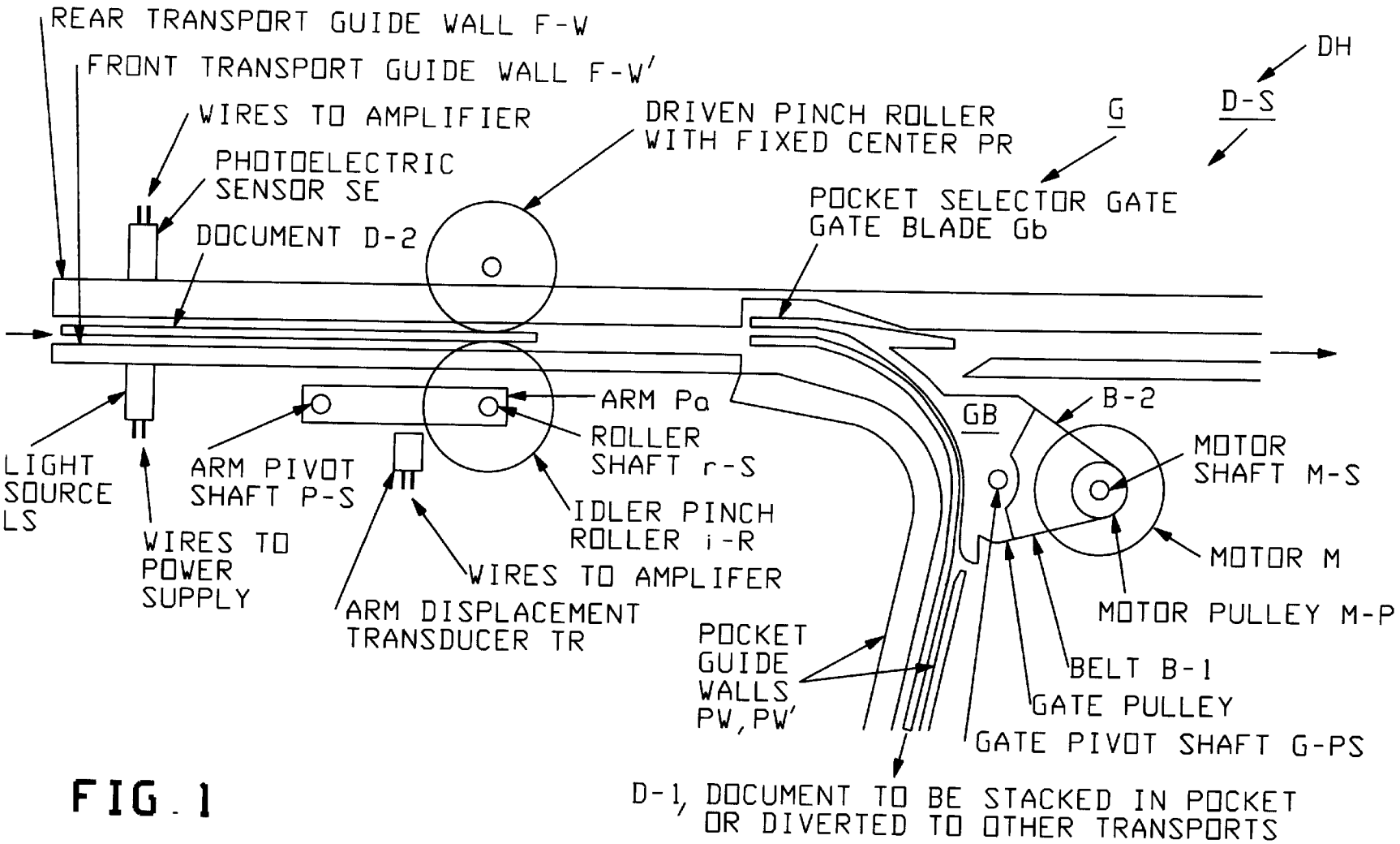
Figure 2:
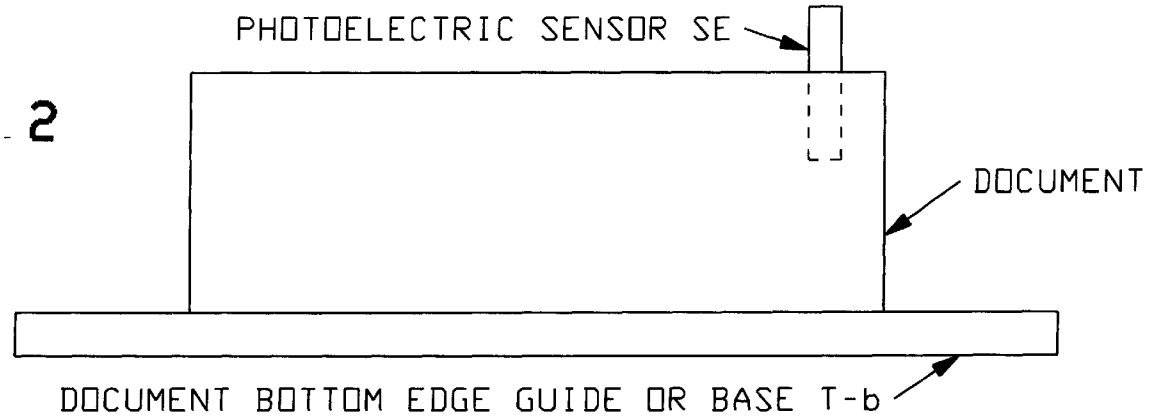
Figure 3:
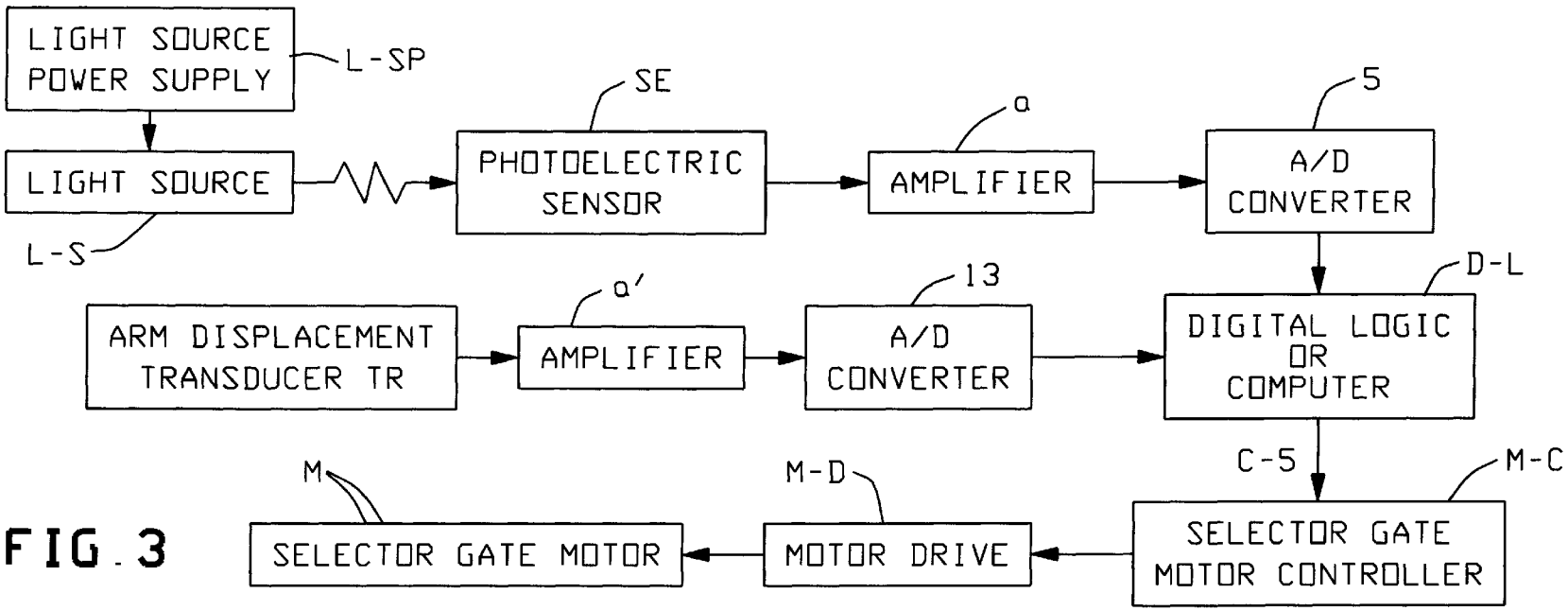
Figure 4:
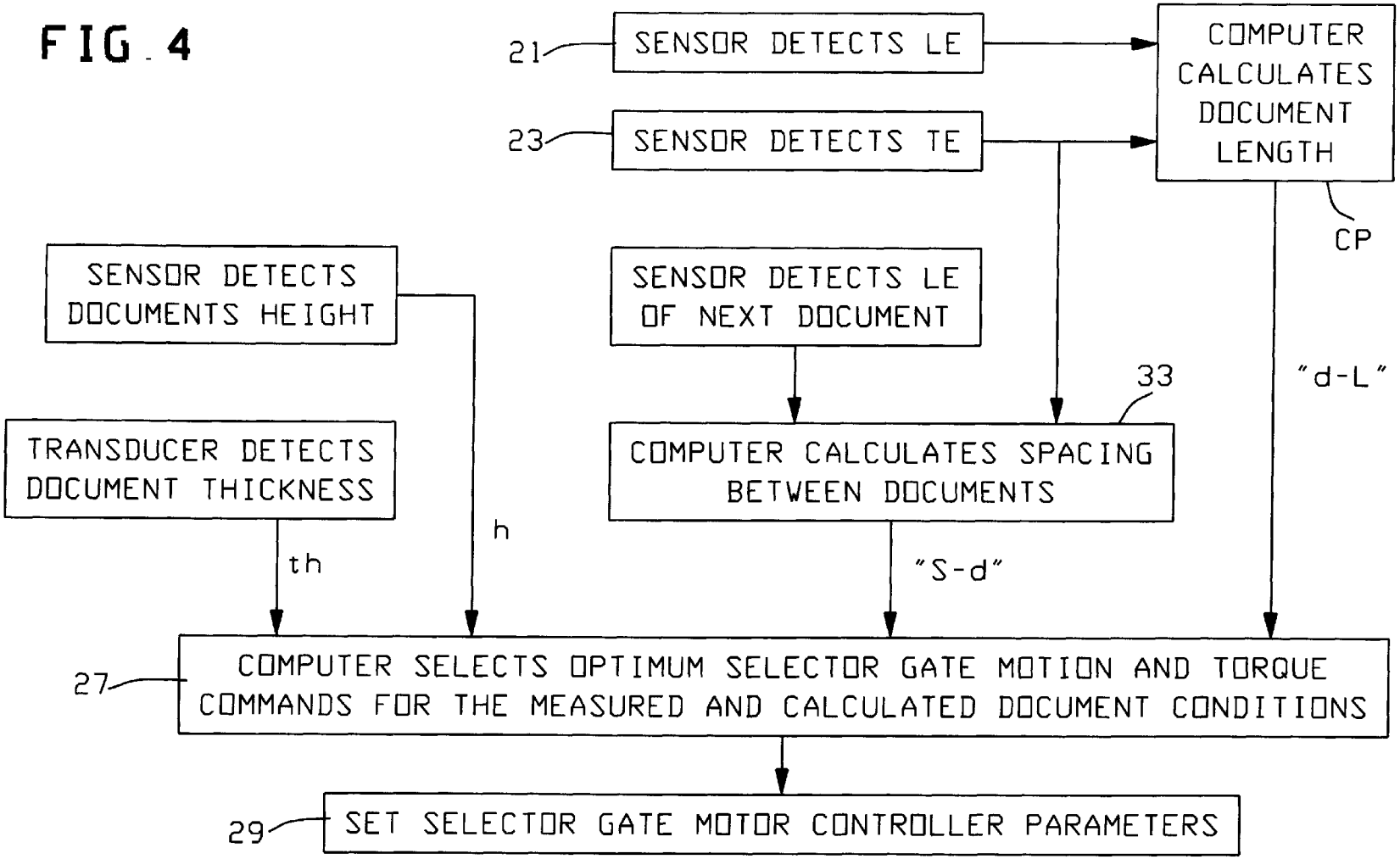

FIG. 1 shows, in plan view, a preferred document select/routing system; FIG. 2 shows a related document-height detector; FIG. 3 is a block diagram of a preferred associated circuit for implementing such a system and FIG. 4 gives a related operational algorithm, for "smart actuation" of a related select gate.

DETAILS OF PREFERRED EMBODIMENT

In FIG. 1, it will be assumed that unit record documents (e.g., checks D-1, D-2) are being automatically, serially transported, processed and manipulated in a "document handling system, DH. A segment D-g of system DH is shown in FIG. 1 as a Diverter Station D-S when the documents will be assumed as serially transported into, along, and beyond, station D-S by suitable high-speed transport means (not shown) along a track T which is defined by a flat base surface T-b (FIG. 2) and a pair of spaced parallel guide-walls T-w, T-w' (FIG. 1)

The Problem:

Referring to FIG. 1, documents are transported down a track by a common transport means (e.g., not shown, but known to those familiar with the state of the art). This invention will work with any number of these transport systems: e.g., rollers, belts, vacuum belts, electrostatic belts, etc., and combinations of these. Also known to those familiar with the state of the art, there are several means of tracking the document and detecting when it gets close to a specific selector gate G which must be actuated if the document is to be diverted along a desired alternate path. An example of this is a check sorter which will read "routing information" printed on the check and then instruct various selector gates to actuate at the appropriate times to place the check in a desired pocket for pick-up and further processing. It is desired that such documents be reliably routed without jamming or being mis-routed.

Referring to FIG. 1, a document D-1 is shown applying pressure to gate G while the gate is in the "open" position, and is diverting document D-1 to a pocket, to be stacked (or to another transport for further processing). The "following" document D-2 may be close behind to maximize system throughput. If following document D-2 must go beyond gate G to another pocket or transport, gate G must perform its closing motion (to then let D-2 pass, continuing along track T) virtually while the first document D-1 is still trying to force G open. This opening force is due to centrifugal and other forces as a result of the change in direction of diverted document D-1.

For "heavy" documents, this "opening force" may well slow down gate G sufficient that the gate does not get out of the way "in time"; get out of guide track T before the leading edge of "following document" D-2 appears at the gate. If this happens, following document D-2 can jam at the gate or be accidentally diverted to an unintended route.

One solution to this problem is to use a gate-actuator with a large force for closing the gate. However, such actuators are often too large to occupy the confined space in document transports. Also, if a "large force" actuator is used, it may cause the gate to move too quickly for light documents, and so possibly make the gate bounce or oscillate back into document track T. Such excess motion would then interfere with the following document, causing a jam or otherwise damaging that document. This invention addresses this problem.

This invention teaches an arrangement of elements that measure the size of the document and adjust gate-actuation accordingly. Since most documents are made of paper, which has a fairly consistent weight/density, document-weight can usually be determined (inferred) essentially from its size (length, height, and thickness). The invention preferably also determines interdocument spacing: such can be measured by common means known to those familiar with the state of the art. The length of the document can also be measured (e.g., in a constant velocity transport) by many common means known to those familiar with the state of the art.

The invention also determines document-thickness; preferably, referring to FIG. 1, the thickness of a document can be measured when it displaces an idler roller i-R normal to the direction of document transport (left to right in this figure). Since the idler roller shaft r-s is connected to an arm P-a which is pivoted about an arm pivot shaft p-s fixed to the transport frame, then arm a will undergo angular displacement about its pivot shaft P-S as a document passes. This arm motion is here, preferably detected by an appropriate transducer TR which converts mechanical position into an electrical signal. Examples of such transducers are eddy current sensors, variable capacitance sensors, reflected light sensors, optical switches, etc., known to those familiar with the state of the art of position detection.

Preferably, this invention also determines document-height. Thus, referring to FIG. 2, a photoelectric sensor SE, located in a recess in the rear transport wall T-w, is exposed to light from a light source 1-s disposed in a recess in the front transport wall. The electrical output signal from sensor SE will be proportional to the total amount of light falling on its surface, as is commonly known by those familiar with the state of the art of photoelectric sensors (sometimes called solar cells). As shown in FIG. 2, a document D-2 is partially covering photoelectric sensor SE, (i.e., D-2 is blocking some of the light from falling on the surface of SE—see dotted-line portion). This causes a varying electrical output signal, depending upon document height—which thus is measured.

FIG. 3 is an block diagram of a preferred electrical system for use in this invention. The electrical signals m, th give respective height and thickness values and are converted to digital signals by respective analog-to-digital converters 5, 13 which are commonly known electronic devices. These digital signals, along with digital signals from commonly known detectors (not shown) for detecting the leading and trailing edges of a document, are stored and manipulated by a digital logic circuit D-L (or computer microprocessor). After suitable manipulation of this information, the digital logic (or computer) sends electrical signals to a selector gate motor controller M-c, which directs the motor driver M-D to drive gate motor M appropriately (see also FIG. 1).

FIG. 4 illustrates an algorithm for "smart actuation" of selector gate G. Using known information (e.g., the constant velocity of the document transport), the time between document leading and trailing edge detections can be used to compute document length, as known in the art. This, together with document height and thickness measurements, and with an assumed paper density value, permits the calculation of document mass. A computer CP can do this, and then instruct motor M to drive gate G (e.g., with high torque to overcome anticipated "large" centrifugal forces on the gate resulting from a "large-mass" document there). Conversely, the computer can instruct motor M to drive gate G with low torque when document mass is determined to be relatively small, and so conserve energy and minimize stress on mechanical and electrical components.

Also, if the so-detected spacing between documents is relatively small, the computer can instruct motor M to move the gate more quickly, to allow a "following document" to pass without jamming at the gate or being misdirected. Conversely, the computer can instruct motor M to drive the gate relatively slowly when the space between documents is large, again conserving energy, minimizing the stressing of mechanical and electrical components and lowering the average acoustic noise.

The algorithm is not limited to only four (4) types of motor commands as described above. Various degrees of motor torques and various degrees of motor speeds, and their combinations, can be commanded with this system to fit the optimal needs of document conditions, and do so in real time.

Although the divert-gate drive system shown in FIG. 1 shows a gate G indirectly driven by motor M through a set of ratioed belts B-1, B-2, this "smart system" will also work with a gate directly driven by a motor. Also, the motor may be of various different types, including stepper, DC permanent magnet, brushless DC, moving coil, electrohydraulic, electropnuematic, etc.

Variations:

Workers will realize that, in some cases, one of these two document variables (mass, spacing) will not need to be monitored (e.g., where only documents of only one-size, common-weight are being run), and, in such a case, the system may be re-programmed accordingly. And, in other cases, a document characteristic (e.g., height) may be invariant, so the system operation may be simplified accordingly (e.g., no height measurement made).

Operation:

Summarizing operations in the "smart gate" array of FIG. 1: when a document (e.g., D-2) is advanced along track T (along base T-b, between walls T-w,T-w', as known in the art) it will pass the photoelectric height-sensor SE: here preferably activated with a light source I-S bracketing the maximum document height (e.g., FIG. 2) with associated, matched photoelectric sensor SE, adapted to output a signal indicating document-height (as known in the art—e.g., according to the % of area of SE covered by document). Connectors cc lead from source I-S to its power supply, and from sensor SE to its output (e.g., to amplifier a etc. as in FIG. 3).

A document entering this "smart gate" station DH, is next preferably advanced to be engaged by a pinch-roll unit PR comprising a fixed-position driving roll D-R (drive by external means, not shown but well known in the art) and an associated idler-roll i-R which is resiliently biased to press a passing document vs fixed roll D-R, as known in the art. More particularly, idler roll i-R is preferably mounted to rotate on a shift r-S which, in turn, is disposed at the distal end of a pivot arm Pa, mounted to pivot, resiliently, about a rigid shaft P-S affixed on the machine frame. It will be understood that as a document (e.g., D-2, FIG. 1) is injected between rollers D-R, i-R, its thickness will cause arm P-a to be pivoted by an amount (e.g., angle) which increases with increasing document thickness. And, accordingly, a suitable transducer TR is arranged to output a "thickness signal" th as a function of this arm displacement (also see FIG. 3, and related amplifier a').

The document next advances to the "diversion-site" (selector-site) where divert-gate G is located; whereupon, gate blade Gb may be actuated, if necessary—i.e., $G_b$ will either let the document continue along track T (see arrow) or divert the document along a "diversion-path" D (e.g., to a sort-pocket, passing between sidewalls P-w,P-w', or alternatively to be diverted to other transport/process means, etc.). Gate blade $G_b$ may be actuated to either position by various suitable means; here, we prefer to do so using a motor M coupled to a gate-body G-B via belt segments B-1,B-2, so that, with body G-B (mounted to be pivoted about a shaft G-PS), motor M may thus either throw the gate blade $G_b$ across track T divertingly, or else pull it clear of track T. To do this, motor M may be actuated either clockwise to pull blade G across track T dirvertingly (e.g., as for D-1 in FIG. 1) via belt segment B-1, or counterclockwise to pull block G-B oppositely (via belt segment B-2) and so pull blade $G_b$ out of track T (i.e., pivot block G-B oppositely). Of course, other like gate actuator means may be substituted.

FIG. 3 indicates a preferred electrical-logic system for so controlling actuation of gate blade $G_b$. Thus, here the mentioned analog signals H, TH representing "height" and "thickness" are preferably converted to digital form, amplified, and presented to a digital processor unit D-L adapted to logically process these (e.g., as pre-programmed, as known in the art) and to output a control signal C-S to a motor control unit M-C. Unit MC will, in turn, responsively apply a related signal to motor driver unit M-D which, in turn, will appropriately activate select-gate motor M (e.g., rotate a suitable amount, either CW or CCW).

It will be recognized that appropriate software can be used to implement some or all of the foregoing. Thus, FIG. 4 summarizes a suitable related algorithm for so actuating such a diverter gate (blade) $G_b$.

Here, it may be assumed that a document has just entered station DH (FIGS. 1–3; e.g., see D-2) and that the system has indicated the document's: LENGTH (cf. via leading-edge detector 21 and trailing-edge detector 23, whose outputs to processor CP, along with programmed velocity value; etc., enable CP to output a "document-length signal"d-L); plus its SPACING (at processor 33 which similarly combines TE indication with LE detector 21 for next-following document—e.g., document D-3, not shown here, to output a SPACE signal S-D) plus height and thickness signals H, TH (as discussed above)—with all these signals indicating the "CONDITION" of document D-2 now approaching gate G, and being applied to processor 27 which is programmed to use them and select optimum gate-motion and torque commands to be applied to a related controller 29 for motor M.

CONCLUSION

While a "smart gate" system is described above and seen as particularly advantageous for use in automated high-speed check sorting machines, as described, workers will readily understand that they have utility for other, analogous applications, such as high-speed currency feeding, handling, document-processing (e.g., printers, document sorters), mail sorters, copiers, punch card transports, envelope stuffing machines, and automatic teller machines, and the like, which require a high-speed means for serially handling and reliably detecting documents, or like sheet units, carried along a track.

In conclusion, it will be understood that the preferred embodiment(s) described herein are only exemplary, and that the invention is capable of many modifications and variations in construction, arrangement and use without departing from the spirit of the claims.

The above examples of possible variations of the present invention are merely illustrative and accordingly, the present invention is to be considered as including all possible modifications and variations coming within the scope of the inventions here described.

What is claimed is:

1. An arrangement for automatically, selectably diverting, different-weight checks being transported along a prescribed track with divert-blade means at a prescribed divert-station therealong, said checks comprising "standard" and "non-standard", heavier versions, this arrangement comprising, in combination with the foregoing:

weight sense means, disposed along said track, upstream of said divert station, for sensing at least a mass characteristic of passing checks and outputting mass-indicating signals SS representative thereof; actuate means arranged to thrust said blade means across said track and associated actuate-adjust means for adjusting actuation-torque of said actuate means responsive to associated torque-adjust signals AA input thereto; and control means arranged to receive said mass-indicating signals SS, manipulating them and applying associated torque-adjust signals AA to said actuate-adjust means whereby to automatically adjust and control the torque applied to said blade means according to the sensed weight condition of a said check; said control means and actuate-adjust means being set to normally handle said "standard" weight checks, and adapted to increase actuation-torque upon detection of a "heavier" check.

2. The invention of claim 1, where said characteristics comprise check-weight, -length, -height, and -thickness.

3. The invention of claim 1, wherein said control means comprises electronic microcomputer means.

4. The invention of claim 1, wherein said actuate means comprises motor means.

5. The invention of claim 4, where said actuate-adjust means comprises selectible torque-transmit means.

6. The invention of claim 1, wherein said arrangement is thus enabled to so thrust said blade means more quickly and forcefully when heavier checks are sensed.

7. The invention of claim 6, where said actuate means comprises motor means.

8. The invention of claim 7, where said actuate-adjust means comprises selectible torque-transmit means.

9. The invention of claim 8, where said control means comprises electronic microcomputer means.

10. The invention of claim 9, where said characteristics comprise check-weight, -length, -height, and -thickness.

* * * * *